US009955275B2

(12) United States Patent
Moore et al.

(10) Patent No.: US 9,955,275 B2
(45) Date of Patent: Apr. 24, 2018

(54) SOUND SIGNAL PROCESSING METHOD AND APPARATUS

(71) Applicants: SAMSUNG ELECTRONICS CO., LTD., Suwon-si (KR); Brian C. J. Moore, Cambridge (GB)

(72) Inventors: Brian C. J. Moore, Cambridge (GB); Young-woo Lee, Seoul (KR); Michael A. Stone, High Peak (GB)

(73) Assignees: SAMSUNG ELECTRONICS CO., LTD., Suwon-si (KR); Brian C. J. Moore, Cambridge (GB)

( * ) Notice: Subject to any disclaimer, the term of this patent is extended or adjusted under 35 U.S.C. 154(b) by 0 days.

(21) Appl. No.: 15/106,639

(22) PCT Filed: Dec. 19, 2014

(86) PCT No.: PCT/KR2014/012599
§ 371 (c)(1),
(2) Date: Jun. 20, 2016

(87) PCT Pub. No.: WO2015/093900
PCT Pub. Date: Jun. 25, 2015

(65) Prior Publication Data

US 2017/0041729 A1 Feb. 9, 2017

(30) Foreign Application Priority Data

Dec. 20, 2013 (KR) ..... 10-2013-0160698

(51) Int. Cl.
*H04R 1/02* (2006.01)
*H04S 1/00* (2006.01)
*H04R 3/00* (2006.01)

(52) U.S. Cl.
CPC ..... *H04S 1/007* (2013.01); *H04S 1/005* (2013.01); *H04R 3/00* (2013.01); *H04S 2400/13* (2013.01); *H04S 2420/01* (2013.01)

(58) Field of Classification Search
USPC ..... 381/1, 2, 26, 89, 97, 94.3, 321, 91, 92
See application file for complete search history.

(56) References Cited

U.S. PATENT DOCUMENTS 6,130,949 A 10/2000 Aoki et al.
7,630,507 B2 12/2009 Kates
(Continued)

FOREIGN PATENT DOCUMENTS

JP 10-313497 A 11/1998
JP H10313497 * 11/1998 ..... G01S 5/18
(Continued)

OTHER PUBLICATIONS

Communications (PCT/ISA/210 & 237) dated Feb. 27, 2015, issued by the International Searching Authority in counterpart International Application No. PCT/KR2014/012599.
(Continued)

*Primary Examiner* — Yosef K Laekemariam
(74) *Attorney, Agent, or Firm* — Sughrue Mion, PLLC

(57) ABSTRACT

A method of processing a sound signal includes obtaining a phase difference or a time difference between sound signals received at both ears; determining a level difference between the sound signals based on the phase difference or time difference; determining gains of the sound signals to be output to both ears based on the level difference; and outputting the sound signals based on the determined gains.

9 Claims, 3 Drawing Sheets

(56) References Cited

U.S. PATENT DOCUMENTS

| | | | | |
|---|---|---|---|---|
| 8,731,212 | B2 | 5/2014 | Takahashi et al. | |
| 2002/0039421 | A1 | 4/2002 | Kirkeby | |
| 2003/0219130 | A1* | 11/2003 | Baumgarte | G10L 19/008 381/17 |
| 2011/0249823 | A1 | 10/2011 | Thomsen et al. | |
| 2012/0070008 | A1* | 3/2012 | Sohn | H04R 25/356 381/23.1 |
| 2012/0093329 | A1 | 4/2012 | Francart et al. | |
| 2014/0219486 | A1 | 8/2014 | Brown | |

FOREIGN PATENT DOCUMENTS

| | | | |
|---|---|---|---|
| JP | 2010-236944 | A | 10/2010 |
| JP | 2011-71655 | A | 4/2011 |

OTHER PUBLICATIONS

Communication (PCT/ISA/220) dated Feb. 27, 2015, issued by the International Searching Authority in counterpart International Application No. PCT/KR2014/012599.

Communication issued by the European Patent Office dated Jul. 6, 2017 in counterpart European Patent Application No. 14872974.2.

Martin Raspaud et al., "Binaural Source Localization by Joint Estimation of ILD and ITD", IEEE Transactions on Audio, Speech, and Language Processing, Jan. 2010, pp. 68-77, XP011329111, vol. 18, No. 1.

* cited by examiner

SOUND SIGNAL PROCESSING METHOD AND APPARATUS

CROSS-REFERENCE TO RELATED APPLICATIONS

This application claims the benefit of priority from Korean Patent Application No. 10-2013-0160698 filed on Dec. 20, 2013 in the Korean Intellectual Property Office, and claims priority from International Application No. PCT/KR2014/012599 filed on Dec. 19, 2014. The disclosures of each of the Applications are herein incorporated by reference in their entirety.

TECHNICAL FIELD

One or more exemplary embodiments relate to a method and apparatus for processing a sound signal received at both ears.

BACKGROUND ART

In order to recognize the directionality of a sound signal, a user has to be able to recognize an interaural time difference (ITD) which is the difference between times that sound signals arrive at both ears of the user or an interaural level difference (ILD) which is the difference between the intensities of the sound signals arriving at both ears. However, a person who is hard of hearing has low sensitivity to the ITD and a high threshold of a sound signal and would feel difficulties recognizing the directionality of the sound signals based on the ITD or the ILD.

Accordingly, there is a growing need to develop a method of processing and outputting sound signals arriving at both ears so that even a person who is hard of hearing sound may recognize the directionalities of the sound signals.

DETAILED DESCRIPTION OF THE INVENTION

Technical Solution

One or more exemplary embodiments include a method and apparatus for processing sound signals arriving at both ears so that a user may easily recognize the directionalities of the sound signals.

Advantageous Effects

According to the one or more of the above exemplary embodiments, sound signals received at both ears may be processed such that even a person who is hard of hearing may easily recognize the directionalities of the sound signals.

BEST MODE

Figure 1:
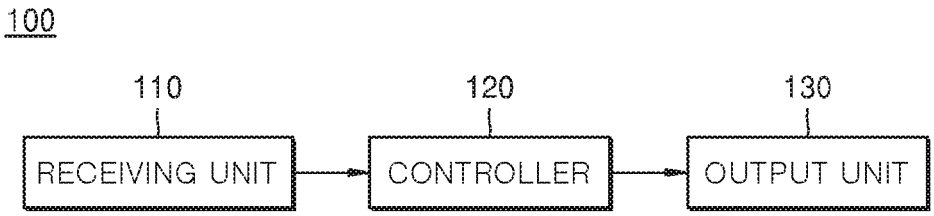
FIG. 1 is a block diagram of a sound signal processing apparatus according to an exemplary embodiment.

According to one or more exemplary embodiments, a method of processing a sound signal includes obtaining a phase difference or a time difference between sound signals received at both ears; determining a level difference between the sound signals based on the phase difference or time difference; determining gains of the sound signals to be output to both ears, based on the level difference; and outputting the sound signals based on the determined gains.

The obtaining of the phase difference or the time difference may include obtaining a phase difference, the absolute value of which is 180 degrees or less by adding 360 degrees to or subtracting 360 degrees from the phase difference when an absolute value of the phase difference exceeds 180 degrees.

The obtaining of the phase difference or the time difference may include determining a threshold of the phase difference based on frequencies of the sound signals; and obtaining the phase difference between the sound signals based on the threshold.

The determining of the level difference may include obtaining the time difference between the sound signals received at both ears from the obtaining phase difference; and determining the level difference between the sound signals received at both ears, based on the time difference.

According to one or more exemplary embodiments, an apparatus for processing a sound signal includes a receiving unit for receiving sound signals at both ears; a controller for obtaining a phase difference or a time difference between the received sound signals, determining a level difference between the received sound signals based on the phase difference or the time difference, and determining gains of the sound signals to be output to both ears, based on the level difference; and an output unit for outputting the sound signals based on the gains.

MODE OF THE INVENTION

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present description. In the following description, well-known functions or constructions are not described in detail if it is determined that they would obscure the inventive concept due to unnecessary detail.

The terms or expressions used in the present specification and the claims should not be construed as being limited to as generally understood or as defined in commonly used dictionaries, and should be understood according to the technical meaning and concept of the inventive concept, based on the principle that the inventor(s) of the application can appropriately define the terms or expressions to optimally explain the inventive concept. Thus, exemplary embodiments set forth in the present specification and the drawings are just exemplary embodiments and do not completely represent the technical idea of the inventive concept. Accordingly, the above exemplary embodiments may not cover all modifications, equivalents, and alternatives falling within the scope of the inventive concept at the filing date of the present application.

It will be understood that the terms 'comprises' and/or 'comprising' when used in this specification, specify the presence of stated features, integers, steps, operations, elements, and/or components, but do not preclude the presence or addition of one or more other features, integers, steps, operations, elements, components, and/or groups thereof. Also, the terms 'unit', 'module', etc. mean units for processing at least one function or operation and may be embodied as hardware, software, or a combination thereof. As used herein, expressions such as 'at least one of,' when preceding a list of elements, modify the entire list of elements and do not modify the individual elements of the list.

Hereinafter, exemplary embodiments will be described in detail with reference to the accompanying drawings.

FIG. 1 is a block diagram of a sound signal processing apparatus 100 according to an exemplary embodiment.

According to an exemplary embodiment, the sound signal processing apparatus 100 may receive sound signals at different locations, process the sound signals, and output the processed sound signals. For example, the sound signal processing apparatus 100 may receive sound signals at locations corresponding to both ears of a user, process the sound signals, and output the processed sound signals. In this case, the sound signal processing apparatus 100 may output the processed signals to both ears of the user so that the user may recognize the directionalities of the respective sound signals received at both ears.

In the following description, the sound signal processing apparatus 100 may process the sound signals according to the difference between the sound signals received at both ears, e.g., at least one among an interaural time difference (ITD), an interaural phase difference (IPD), and an interaural level difference (ILD).

The ITD may be understood as a time difference between the sound signals received at both ears. The IPD may be understood as the difference between angles of the sound signals received at both ears. The ITD is a time-domain value and may be transformed into a frequency-domain value. The IPD is a frequency-domain value and may be transformed into a time-domain value.

The ILD may be understood as the difference between levels, i.e., intensities, of the sound signals received at both ears. The greater the ILD, the greater the difference between the intensities of the sound signals received at both ears may be.

The ILD may increase in proportion to frequencies of the sound signals. This is because the higher the frequencies of the sound signals, the lower a degree to which the sound signals diffract. That is, as the frequency of a sound signal become higher, the sound signal that first arrived at one of ears may arrive to the other ear at a lower diffraction angle and thus the intensity of the sound signal arriving at the other ear may decrease to a greater extent, thereby increasing the ILD. In contrast, as the frequency of the sound signal becomes lower, the sound signal that first arrived at one of ears may diffract to a greater extent and may thus easily arrive at the other ear. Thus, the intensity of the sound signal may decrease to a relatively small extent, thereby decreasing the ILD.

Thus, the lower the frequencies of the sound signals, the less the ILD. In general, when a sound signal has a frequency of 1500 Hz or less, the ILD may be too low to be measured or recognized.

A user may recognize the directionalities of sound signals by recognizing the ILD or the ITD between the sound signals. However, a person who is hard of hearing may have difficulty recognizing the ITD. Thus the directionalities of the sound signals are difficult for him/her to recognize. Also, since a sound signal diffracts to a large extent when the frequency of the sound signal is low, the ILD is low. Thus, a person who has difficulty recognizing the ITD may also have difficulty recognizing the ILD. Thus, the directionalities of the sound signals are difficult for him or her to recognize.

When the ILD is measurable, the sound signal processing apparatus 100 may increase gains of the respective sound signals, and output the sound signals such that a level difference between the sound signals is maintained to be the ILD so as to improve a user's ability to recognize directionality or a language. In this case, a person who is hard of hearing and has difficulty recognizing the ITD may recognize the directionalities of the sound signals by recognizing the ILD.

However, when frequencies of the sound signals are too low to measure the ILD, it is difficult for the sound signal processing apparatus 100 to increase gains of the sound signals and output the sound signals according to the ILD. If an ILD between low-frequency sound signals is too low, a person who is hard of hearing may have difficulty recognizing the ILD from the output sound signals even when the sound signal processing apparatus 100 increases the gains of the sound signals according to the ILD and outputs the sound signals.

According to an exemplary embodiment, the sound signal processing apparatus 100 may determine an ILD based on an IPD or an ITD, and process and output the sound signals based on the determined ILD even when the frequencies of the sound signals are low. Even if the frequencies of the sound signals are low, an IPD or an ITD is present according to the directionality of the sound signal. Thus, the sound signal processing apparatus 100 may determine an ILD based on the IPD or the ITD such that the directionalities of the sound signals are recognizable. For example, the sound signal processing apparatus 100 may apply a predetermined value to an ILD transformation equation using an IPD or an ITD so as to determine the ILD based on the IPD or the ITD such that the directionalities of the sound signals are recognizable.

In detail, when the frequencies of the sound signals are too low to measure the ILD, the sound signal processing apparatus 100 may determine the ILD from the IPD or the ITD. For example, the sound signal processing apparatus 100 may determine the ILD to be proportional to the IPD or the ITD. Then the sound signal processing apparatus 100 may increase gains of the sound signals based on the determined ILD and output the sound signals such that a level difference between the sound signals may be maintained to be the determined ILD.

Thus, even if the frequencies of the sound signals are low, a user may recognize the directionalities of the sound signals output from the sound signal processing apparatus 100 according to an exemplary embodiment since the ILD is determined to be recognizable. Thus, even a person who is hard of hearing may recognize the directionalities of the sound signals since the sound signal processing apparatus 100 may output the sound signals by increasing the ILD. Also, a user's ability to recognize a language contained in the sound signals since the sound signals may be amplified according to the ILD.

In this case, when the sound signals are output near both ears of a person who is hard of hearing from the sound signal processing apparatus 100, the sound signals may appropriately diffract and the ILD may be thus sufficiently recognizable even if the sound signals have a low frequency. This is because even a person who is hard of hearing is able to recognize an ILD between low-frequency sound signals output near both ears and easily recognize the ears via which he or she listens to the sound signals. That is, since the sound signals to which the ILD is applied and which is output from the sound signal processing apparatus 100 may be output at different levels near both ears of a person who is hard of hearing, the person who is hard of hearing may easily recognize the ILD between the sound signals.

The sound signal processing apparatus 100 according to an exemplary embodiment may include various types of apparatuses capable of outputting sound signals to both ears of a user. For example, the sound signal processing apparatus 100 may include a two-ear hearing aid, a headphone, an earphone, etc. The sound signal processing apparatus 100 may further include a microphone for receiving an external sound signal but is not limited thereto. In addition to the above examples, the sound signal processing apparatus 100 may be understood as a concept including all various apparatuses capable of establishing communication, which have been developed and placed on the market and that will be developed in the near future.

Referring to FIG. 1, the sound signal processing apparatus 100 may include a receiving unit 110, a controller 120, and an output unit 130. However, all of these components are not indispensable components. The sound signal processing apparatus 100 may further include other components or only some of these components.

The receiving unit 110 may receive an external sound signal. For example, although not shown, the receiving unit 110 may include a microphone for collecting an external sound signal or a communication module for receiving a sound signal from an external device. In this case, sound signals received via the receiving unit 110 may be sound signals collected at different locations, e.g., sound signals collected via both ears of a user. The sound signals received via the receiving unit 110 may be processed by and output from the sound signal processing apparatus 100.

In general, the controller 120 may control overall operations of the sound signal processing apparatus 100. For example, the controller 120 may process the sound signals received via the receiving unit 110 and control the processed sound signals to be output via the output unit 130. According to an exemplary embodiment, the controller 120 may process and output the sound signals such that a user may recognize the directionalities of the output sound signals.

The output unit 130 may output the sound signals processed by the controller 120. For example, the output unit 130 may output the sound signals processed such that the directionalities of the sound signals are recognizable, via a speaker, an earphone, or a headphone. In this case, the output unit 130 may output the sound signals near the ears of a person who is hard of hearing so that he or she may recognize an ILD between the sound signals to easily recognize the directionalities of the sound signals.

Figure 2:
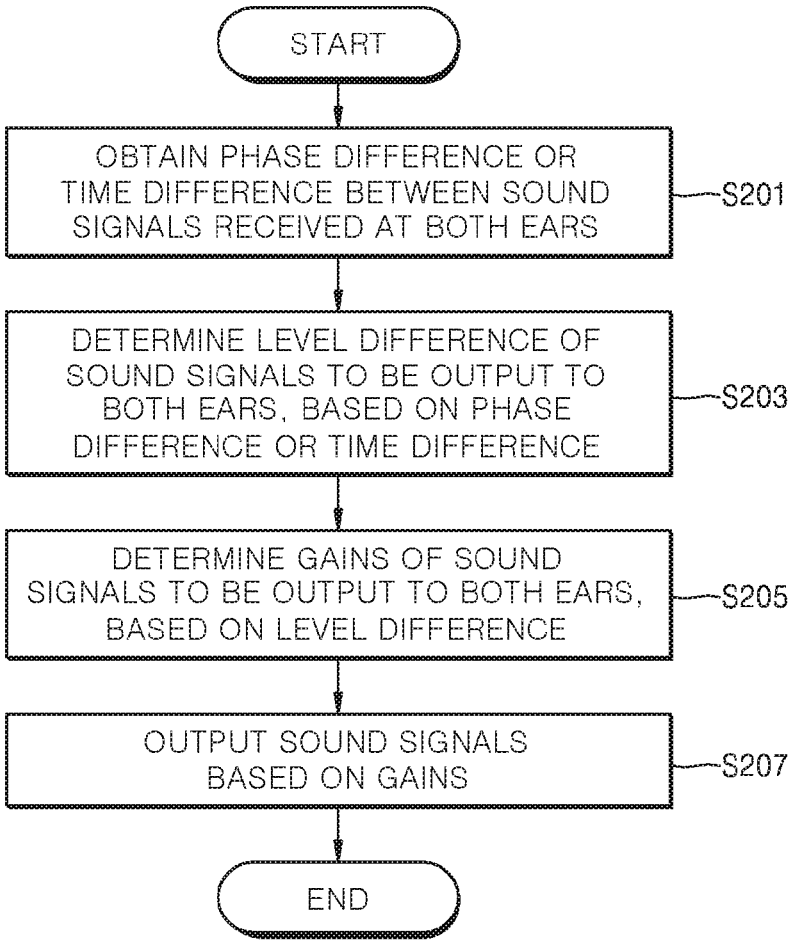
FIGS. 2 and 3 are flowcharts of methods of processing a sound signal according to exemplary embodiments.
Figure 3:
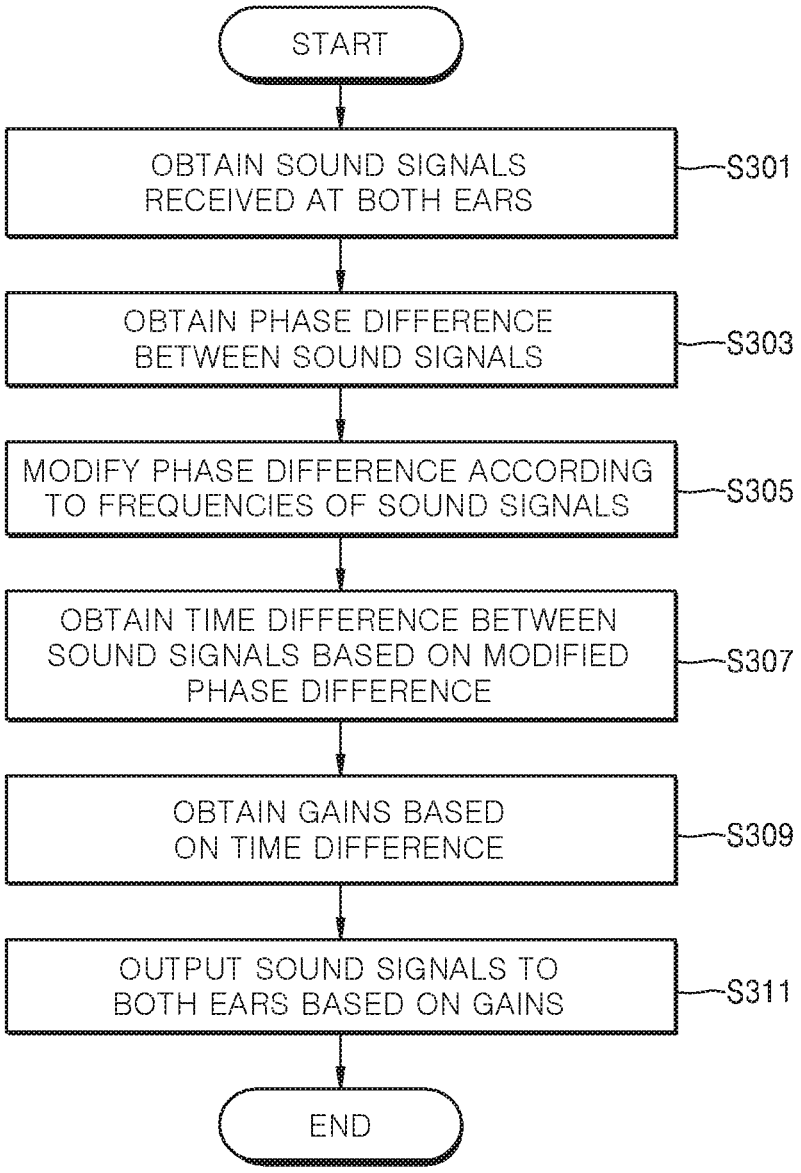

FIGS. 2 and 3 are flowcharts of methods of processing a sound signal according to exemplary embodiments.

Referring to FIGS. 1 and 2, in operation S201, the sound signal processing apparatus 100 may obtain an IPD which is a phase difference between sound signals received at both ears of a user or an ITD which is a time difference between the sound signals. In this case, the sound signals may be repeatedly processed by the sound signal processing apparatus 100 in a unit in which the sound signals are processed.

For example, the unit in which the sound signals are processed may be a bin which is one of signal processing units. The sound signal processing apparatus 100 may transform the sound signals received via the receiving unit 110 into frequency domain signals, and obtain a phase difference between the frequency-domain signals in units (e.g., bins) in which the sound signals are processed.

Otherwise, the sound signal processing apparatus 100 may obtain the difference between times that the same sound signal is received at different locations in a time domain in units in which the sound signals received via the receiving unit 110 are processed.

In operation S203, the sound signal processing apparatus 100 may determine an ILD which is a level difference between sound signals to be output to both ears of a user, based on the phase difference or the time difference obtained in operation S201. In this case, the sound signal processing apparatus 100 may transform the IPD which is a phase difference in a frequency domain into the ITD which is a difference in a time domain, and determine the ILD based on the ITD. For example, the ILD may be determined to be proportional to the IPD or the ITD, because the distance between the sound signals arriving at both ears may increase according to the ITD or the IPD and the difference between the intensities of the sound signals may vary according to the distance between the sound signals.

In operation S205, the sound signal processing apparatus 100 may determine gains of the sound signals to be output to both ears, based on the ILD which is the level difference determined in operation S203. That is, the sound signal processing apparatus 100 may determine the intensities of the sound signals to be output to both ears, based on the ILD.

In operation S207, the sound signal processing apparatus 100 may apply the gains determined in operation S205 to the sound signals received in operation S201, and output the gain-applied sound signals to both ears.

The sound signal processing apparatus 100 may set a maximum value of an IPD, determine an IPD based on the maximum value of the IPD, and process sound signals in the method of processing a sound signal which will be described with reference to FIG. 3 below.

Referring to FIGS. 1 and 3, in operation S301, the sound signal processing apparatus 100 may obtain sound signals received at both ears. That is, the sound signal processing apparatus 100 may obtain sound signals received at both ears of a user. The sound signal processing apparatus 100 may process the obtained sound signals and output the processed sound signals to both ears of the user so that the user may easily recognize the directionalities of the sound signals output to both the ears.

In operation S303, the sound signal processing apparatus 100 may obtain a phase difference between the sound signals received at both ears. In this case, the sound signal processing apparatus 100 may transform the sound signals in a time-domain into a frequency domain and compare corresponding sound signals with each other to obtain a phase difference between the transformed sound signals.

For example, a signal may be expressed in the form of an amplitude and a phase when Fourier transformation is performed to transform the signal into a complex-number between the sound signals by performing Fourier transformation to transform the sound signals into a frequency-domain. In this case, the phase difference may be obtained in units in which the sound signals are processed. That is, a method of processing a sound signal according to an exemplary embodiment may be performed in units in which the sound signals are processed.

In operation S305, an IPD which is the phase difference obtained in operation S303 may be modified according to the frequencies of the sound signals received in operation S301. In addition, ambiguity of the IPD may be checked, and modified according to a maximum value of the IPD determined based on a frequency.

In detail, the sound signal processing apparatus 100 may check and modify the ambiguity of the IPD based on whether an absolute value of the IPD exceeds 180 degrees, or check and modify the IPD based on a threshold IPD determined for each of frequencies.

When the absolute value of the IPD exceeds 180 degrees, 360 degrees may be added to or subtracted from the IPD to modify the IPD to be 180 degrees or less. Since sound signals are received at both ears of a user in opposite directions, the difference between angles of the sound signals received at both ears of a user is maximum when one of the sound signals is received at one of both ears at a right angle. Thus, an absolute value of the maximum difference between the angles of the sound signals may be 180 degrees. Thus, the sound signal processing apparatus 100 may modify the IPD to be 180 degrees or less when an absolute value of the IPD exceeds 180 degrees. In this case, the IPD may be a positive value or a negative value according to which one of both ears is a reference point. For example, when a right ear is a reference point, an IPD between one of the sound signals that first arrives at the right ear and the other sound signal that thereafter arrives at the left ear may be a negative value.

Also, the sound signal processing apparatus 100 may check and modify the ambiguity of the IPD based on a threshold IPD for each of frequencies of the sound signals so as to prevent an error from occurring when the length of a path for delivering sound to both ears exceeds half the wavelength of a central frequency and thus a maximum phase difference exceeds 180 degrees, i.e., the difference between phases of frequency components having a threshold frequency or more exceeds 180 degrees.

Equation 1 below denotes a maximum angle for each of frequencies. For example, in the case of an average head size, an IPD exceeds 180 degrees at a frequency of about less than 769 Hz and ambiguity of the IPD does not occur. However, ambiguity occurs at a frequency higher than 769 Hz. Thus, a threshold IPD for each of frequencies may be determined, and the IPD may be modified by adding 360 degrees to or subtracting 360 degrees from the IPD when the IPD is greater than the threshold IPD.

$$IPD(max)=0.65*(\text{center frequency})*360/1000\ (\text{degree}), \quad \text{[Equation 1]}$$

wherein 0.65 ms denotes a moving time between both ears when one of the sound signals is received at one of both ears at a right angle as described above. The moving distance of the sound signals to be received between both ears may be the same as half the size of a head circumference. Thus, a time difference corresponding to a time value during which a sound signal moves from one ear to another ear may be equal to a value obtained by dividing half the head circumference by the speed of sound.

For example, if it is assumed that half the head circumference is 22 cm, the time difference may be 0.65 ms since the speed of sound in the air is 340 m/s. In this case, half the head circumference may vary according to the size of a user's head circumference. That is, in Equation 1, the time difference is not limited to 0.65 ms and may be set to another value according to the size of the user's head circumference.

In operation S307, the sound signal processing apparatus 100 may obtain an ITD between the sound signals received at both ears, based on the IPD modified in operation S305. According to an exemplary embodiment, the sound signal processing apparatus 100 may obtain the ILD by transforming the IPD into an ITD. However, exemplary embodiments are not limited thereto and the ILD may be obtained in other various ways without transforming the IPD into the ITD. In this case, operation S307 may be skipped.

In operation S309, the sound signal processing apparatus 100 may obtain an ILD corresponding to the difference between the intensities of the sound signals, based on the ITD obtained in operation S307 or the IPD obtained in operation S305. Also, the sound signal processing apparatus 100 may determine gains to be applied to the respective sound signals, based on the ILD. That is, the sound signal processing apparatus 100 may determine gains to be applied to the respective sound signals such that the difference between levels of the sound signals to be output to both ears of a user may be equal to be the ILD.

For example, the ILD may be calculated from the ITD according to Equation 2 below.

$$ILD(i)=ILDmax*[(\text{sine}(\text{abs}(ITD(i)*90/0.65))]0.9, \quad \text{[Equation 2]}$$

wherein 'ILDmax' denotes a maximum value of the ILD to be applicable, (ITD(i)*90/0.65) denotes an angle, and 'ITD' denotes a unit expressed in ms. When sound signals reach the sound signal processing apparatus 100 at a right angle, the ITD has a maximum value of 0.65 ms, and an ILD to be applied may be calculated as the maximum value of the ILD ILDmax. In operation S311, the sound signal processing apparatus 100 may apply the gains determined in operation S309 to the respective sound signals and then output the processed sound signals to both ears.

Figure 4:
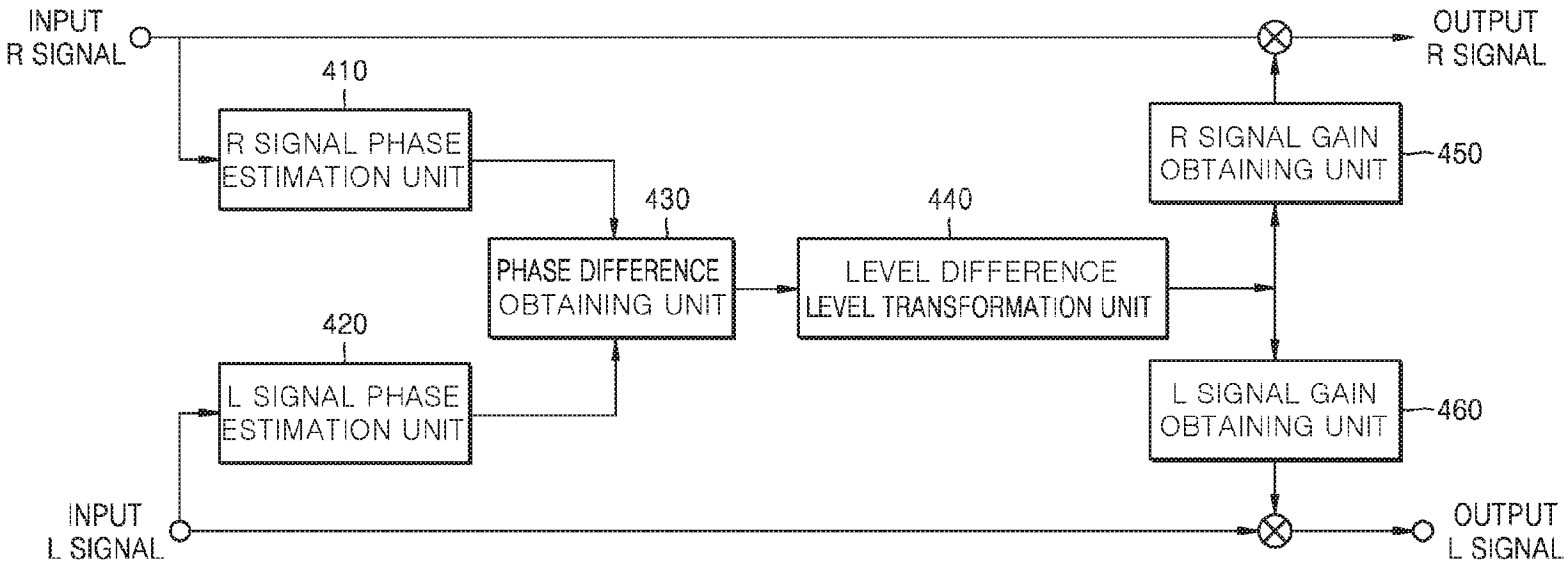
FIG. 4 is a block diagram illustrating a method of processing a sound signal according to an exemplary embodiment.

FIG. 4 is a block diagram illustrating a method of processing a sound signal according to an exemplary embodiment.

Referring to FIG. 4, sound signals which are to be received at a right ear and a left ear, respectively, may be input as an R signal and an L signal to a sound signal processing apparatus 400. The R and L signals are processed by and output from the sound signal processing apparatus 400.

An R-signal phase estimation unit 410 may calculate a phase of the R signal and an L-signal phase estimation unit 420 may calculate a phase of the L signal. In this case, the phases of the R signal and the L signal may be obtained in a corresponding unit among units in which sound signals are processed.

A phase difference obtaining unit 430 may calculate the difference between the phases of the R signal and the L signal to obtain an IPD. In this case, when an absolute value of the IPD exceeds 180 degrees, the phase difference obtaining unit 430 may check ambiguity of the IPD by adding 360 degrees to or subtracting 360 degrees from the IPD, and modify the IPD by calculating a maximum value of the IPD according to the frequency of the R signal or the L signal. That is, the phase difference obtaining unit 430 may check the ambiguity of the IPD and modify the IPD according to the maximum value of the IPD.

A level difference transformation unit 440 may obtain the ILD from the IPD obtained or modified by the phase difference obtaining unit 430. For example, the level difference transformation unit 440 may obtain the ILD by transforming the IPD into an ITD. Since the ITD is a time difference, the level difference transformation unit 440 may obtain the ILD by calculating the difference between the intensities of the sound signals arriving at both ears according to times required to transmit the sound signals.

An R-signal gain obtaining unit 450 and an L-signal gain obtaining unit 460 may calculate gains to be applied to the R signal and the L signal, based on the ILD obtained by the level difference transformation unit 450. The gains calculated by the R-signal gain obtaining unit 450 and the L-signal gain obtaining unit 460 may be applied to the R signal and the L signal input to the sound signal processing apparatus 400, and then the gain-applied R and L signals may be output from the sound signal processing apparatus 400.

Referring to FIG. 4, the R signal and the L signal are processed together by the same processors, i.e., the phase difference obtaining unit 430 and the level difference transformation unit 440. However, exemplary embodiments are not limited thereto and the sound signal processing apparatus 400 according to an exemplary embodiment may include an R-signal phase difference obtaining unit, an L-signal phase difference obtaining unit, an R-signal level difference transformation unit, and an L-signal level difference transformation unit to individually process the R signal and the L signal. That is, an R-signal process and an L-signal process may be performed by different processors. In this case, the IPD may be obtained by obtaining both the R signal and the L signal by each of the R-signal phase difference obtaining unit and the L-signal phase difference obtaining unit.

As described above, according to the one or more of the above exemplary embodiments, sound signals received at both ears may be processed such that even a person who is hard of hearing may easily recognize the directionalities of the sound signals.

In addition, according to the one or more of the above exemplary embodiments, sound signals received at both ears may be processed to provide sound signals, the intensities of which are stronger than those of the sound signals in directions in which the sound signals are received, so that even a person who is hard of hearing may easily recognize the sound signals.

The methods according to the one or more of the above exemplary embodiments can be embodied as computer-readable code in a recording medium that is readable by a computer (including all various apparatuses with an information processing function). The computer-readable medium may be any recording apparatus capable of storing data that is read by a computer system, e.g., a read-only memory (ROM), a random access memory (RAM), a compact disc (CD)-ROM, a magnetic tape, a floppy disk, an optical data storage device, and so on.

It should be understood that the exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims.

The invention claimed is:

1. A method of processing a sound signal, the method comprising:

measuring a value of a phase difference or a time difference between a first sound signal and a second sound signal, wherein the first sound signal is received from a left side microphone, and the second sound signal is received from a right side microphone;

determining a value of a level difference to be proportional to the value of the phase difference or the time difference;

determining a first gain of the first sound signal and a second gain of the second sound signal, based on the determined value of the level difference;

processing the first sound signal and the second sound signal based on the determined first gain and the determined second gain; and outputting the processed first sound signal and the processed second sound signal via speakers.

2. The method of claim 1, wherein the measuring of the value of the phase difference or the time difference comprises measuring a value of a phase difference, the absolute value of which is 180 degrees or less by adding 360 degrees to or subtracting 360 degrees from the phase difference when an absolute value of the phase difference exceeds 180 degrees.

3. The method of claim 1, wherein the measuring of the value of the phase difference or the time difference comprises:

determining a threshold of the phase difference based on frequencies of the first sound signal and the second sound signal; and measuring the value of the phase difference between the first sound signal and the second sound signal based on the threshold.

4. The method of claim 1, wherein the determining of the value of the level difference comprises:

obtaining the value of the time difference between the first sound signal and the second sound signal from the value of phase difference; and determining the value of the level difference to be proportional to the obtained value of time difference.

5. An apparatus for processing a sound signal, the apparatus comprising:

a receiving unit comprising a left side microphone and a right side microphone for receiving a first sound signal and a second sound signal;

a controller for:

measuring a value of a phase difference or a time difference between a first sound signal and a second sound signal, determining a value of a level difference to be proportional to the value of the phase difference or the time difference, and determining a first gain of the first sound signal and a second gain of the second sound signal, based on the determined value of the level difference and processing the first sound signal and the second sound signal based on the determined the first gain and the second gain; and an output unit for outputting the processed first sound signal and the processed second sound signal via speakers.

6. The apparatus of claim 5, wherein the controller measures a value of a phase difference that is 180 degrees or less by adding 360 degrees to or subtracting 360 degrees from the phase difference when an absolute value of the phase difference exceeds 180 degrees.

7. The apparatus of claim 5, wherein the controller determines a threshold of the phase difference based on frequencies of the first sound signal and the second sound signal, and measures the value of the phase difference between the first sound signal and the second sound signal according to the threshold.

8. The apparatus of claim 5, wherein the controller obtains the value of the time difference between the first sound signal and the second sound signal from the value of the phase difference, and determines the value of the level difference to be proportional to the obtained value of the time difference.

9. A non-transitory computer-readable recording medium having recorded thereon a program for performing a method of processing a sound signal, the method comprising:

measuring a value of a phase difference or a time difference between a first sound signal and a second sound signal, wherein the first sound signal is received from a left side microphone, and the second sound signal is received from a right side microphone;

determining a value of a level difference to be proportional to the value of the phase difference or the time difference;

determining a first gain of the first sound signal and a second gain of the second sound signal, based on the determined value of the level difference;

processing the first sound signal and the second sound signal based on the determined the first gain and the second gain; and outputting the processed first sound signal and the processed second sound signal via each speakers.

* * * * *